United States Patent [19]

Schmidlin

[11] 4,094,247

[45] June 13, 1978

[54] SWITCH ACTUATOR

[75] Inventor: Albertus E. Schmidlin, Caldwell, N.J.

[73] Assignee: The United States of America as represented by the Secretary of the Army, Washington, D.C.

[21] Appl. No.: 771,214

[22] Filed: Feb. 23, 1977

[51] Int. Cl.[2] ..... F42C 15/00

[52] U.S. Cl. ..... 102/228; 102/263

[58] Field of Search ..... 102/70.2 R, 76 R, 81

[56] References Cited

U.S. PATENT DOCUMENTS

| | | | |
|---|---|---|---|
| 3,416,451 | 12/1968 | Hamerla | 102/70.2 R |
| 3,841,220 | 10/1974 | Murphy | 102/70.2 R |
| 4,019,441 | 4/1977 | Morgen et al. | 102/70.2 R |

*Primary Examiner*—Charles T. Jordan

*Attorney, Agent, or Firm*—Nathan Edelberg; A. Victor Erkkila; Max Yarmovsky

[57] ABSTRACT

A switch actuator, for safe and arm applications requiring utmost dependability in order to preclude a premature or false arming sequence, utilizes a plurality of simultaneous input signals from independently coded pneumatic optical and electrical sources to drive a rotary switch. A rotary fluidic valving plate is used to decode non-uniform input optical signals into a uniform cyclical output pressure signal which is used to drive a fail-safe, reversible pneumatic piston type motor. A geneva mechanism is used to mechanically couple the prime mover to an output gear.

5 Claims, 5 Drawing Figures

SWITCH ACTUATOR

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to safe and arm a missile and to prevent the missile from being prematurely, or inadvertently detonated by an extraneous signal. Frequently it is necessary to assume with a minimum of uncertainty that all the conditions of a normal flight are satisfied before the final arming sequence is accomplished. Usually safing and arming signatures are monitored by on board sensors and processed by logic circuits before the arming sequence is finally initiated. After all conditions are satisfied within the acceptable limit of uncertainty, it is necessary to transmit intelligence signals across a physical isolated zone to the warhead critical circuits. Previous methods in some instances utilized dual signal paths and/or coded signals, usually electrical in nature to transmit the intelligence across the isolation distance. One of the problems with prior art devices utilizing coded electromagnetic radiations to activate the critical circuit has been their susceptibility to being jammed or fired by electronic or nuclear countermeasures. In other instances the aforementioned devices have been found to be susceptible to premature firing because of the electrical breakdown of a circuit component due to leakage currents or the shorting of a critical element aggravated by a severe environmental stress condition. The problem with the use of D.C. operated switches or use of standard type stepping motors in missile applications is that they can easily be made to malfunction upon receipt of a random noise or spurious electrical signal which places the missile in a condition of fail-arm rather than fail-safe. Multiphase motors are likewise generally unsuitable for missile switching applications because of their low holding and operating torque and the adverse affects thereon by the high stresses imposed by spin, pitch, yaw and setback forces of the missile. In view of the aforementioned problems the present invention overcomes these problems by making the critical arming function dependent upon input signals via three different transmission media which are not readily subject to change from high stress environments nor electronic countermeasures.

SUMMARY OF THE INVENTION

The present invention relates to a switch actuator utilizing a dual coded optical input which is transduced by a photosensitive cell into an electrical signal which is amplified and then converted by a solenoid means into a pneumatic signal of the same coded format. The pneumatic coded signals are decoded by a rotary decoding plate valve which is geared to a pneumatic prime mover. The prime mover is biasedly mechanically connected through a geneva drive mechanism to a rotary switch drive. The prime mover must receive a plurality of consecutive properly timed pneumatic pulse signals before an output switching action will be initiated by the device.

An object of the present invention is to provide a switch actuator for a hard switch device which cannot be closed by accidental crushing or imposition of accidental accelerating forces.

Another object of the present invention is to provide a switch actuator which cannot be inadvertently caused to prematurely function by an extraneous or spurious input signal.

Another object of the present invention is to provide a switch actuator which cannot be defeated by electronic countermeasures or jamming.

Another object of the present invention is to provide a switch actuator which will not be susceptible to premature operation because of electrical breakdown due to leakage currents or shorting.

Another object of the present invention is to provide a switch actuator which will fail-safe rather than fail-arm.

Another object of the present invention is to provide a switch actuator which precludes premature operation by requiring an input signal generated from three different forms of energy, optical, electrical and pneumatic before switch action is initiated.

A further object of the present invention is to provide a switch actuator which insures against premature switch closure by requiring a uniquely coded optical signal of a specific duration to be first converted to an electrical signal of the same coded format then converted by a solenoid to a pneumatically coded signal, and decoded mechanically by a rotating plate type valve to supply properly timed gas pulses to actuate a pneumatic piston type motor which drives a rotary switch.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
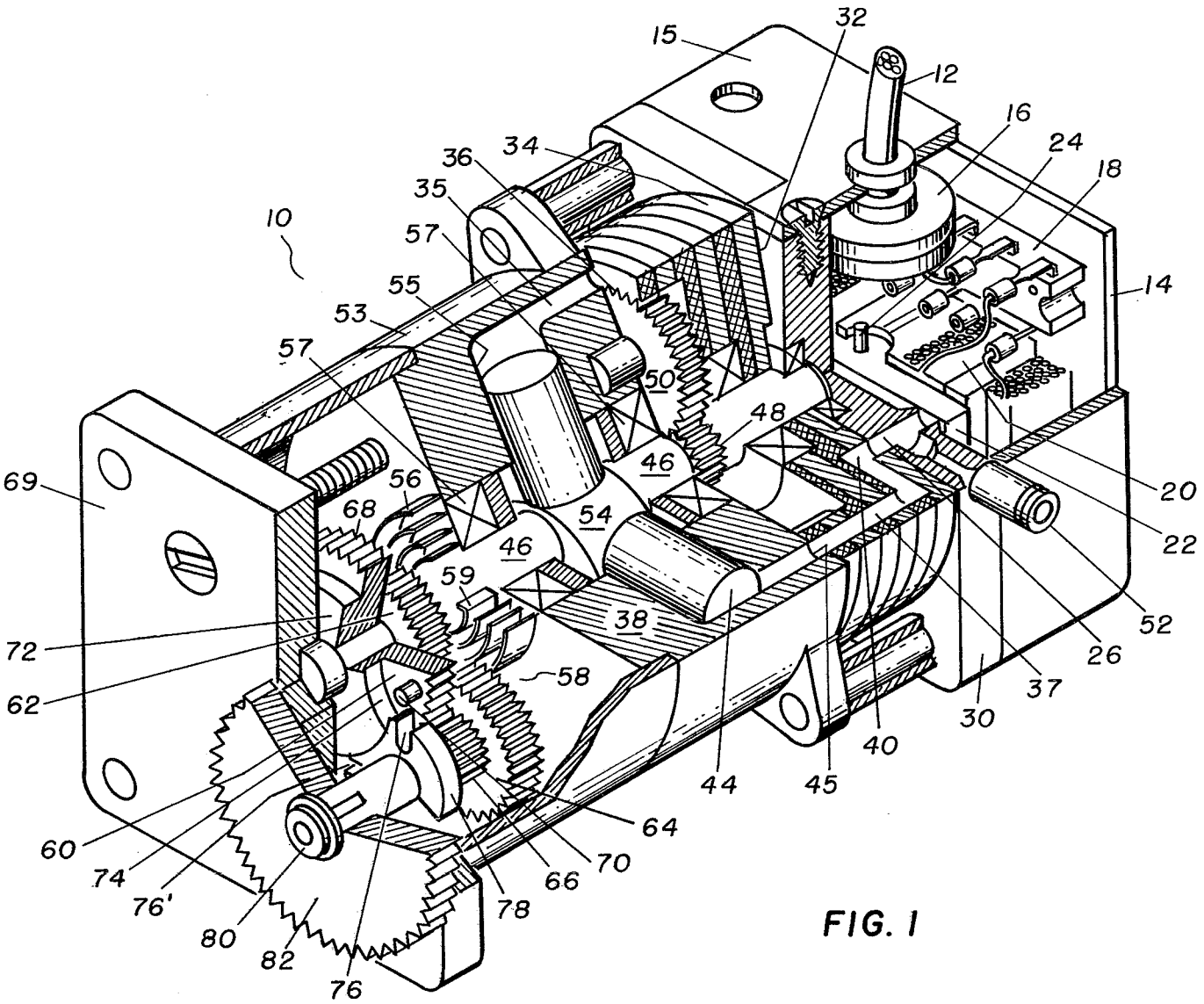
FIG. 1 is a partial cutaway cross-sectional isometric view of the switch actuator.
Figure 4:
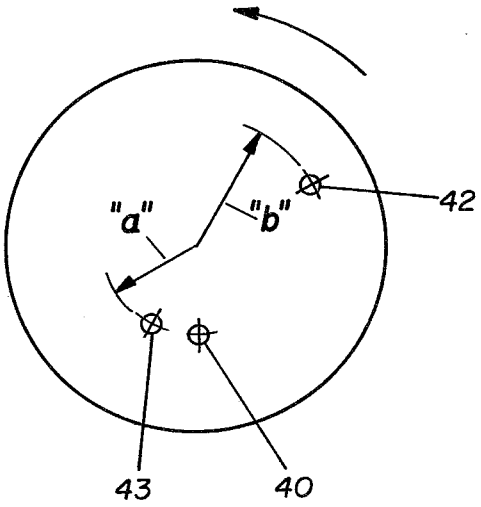
FIG. 4 is a view taken along line 4—4 of FIG. 2 showing the nonsymmetrical positions of the input ports of the rotating plate decoding valve on its input side.
Figure 2:
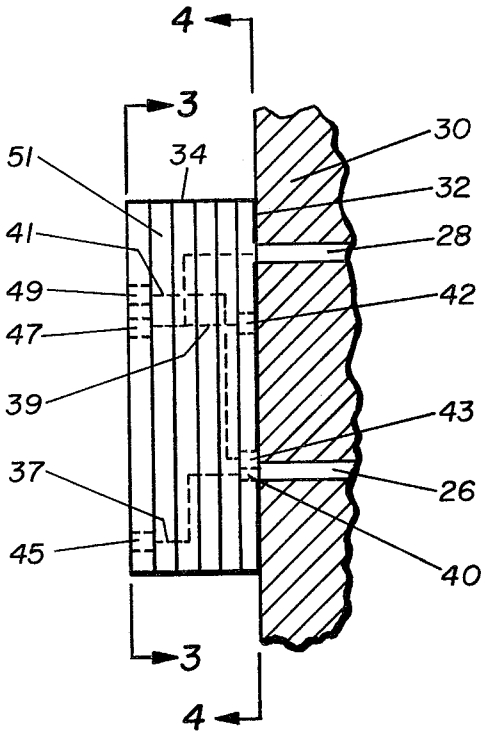
FIG. 2 is a partial cross-section of the fixed cover plate and a diagramatic side view of the pneumatically decoding rotating valve plate.
Figure 3:
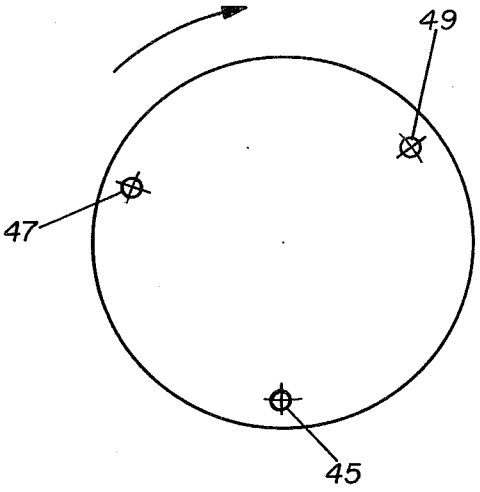
FIG. 3 is a view taken along line 3—3 of FIG. 2 showing the symmetrical positions of the exit ports of the rotating plate decoding valve on its output side.

Referring now to FIG. 1 the actuator assembly 10 receives a control input coded signal by means of a fiber optic cable 12 which is fixedly held to housing 14 and passes through housing cover 15. Fiber optic cable 12 is positioned so that its output end is optically in-line with the input of a photosensitive cell 16. Photosensitive cell 16 converts the coded optical signal to a coded electrical signal of the same format and transmits a coded pulse signal to an amplifier circuit 18 which generates an amplified coded electrical output signal. The amplified coded electrical output signal of amplifier 18 is electrically coupled to a solenoid 20 which magnetically moves pivotable flapper valve 22 causing it to oscillate about pivot 24 in accordance with the amplified coded electrical pulse signature. The format of the optical, electrical, pneumatic signals consist of 24 bits in series on each of two separate channels. The pulses are varying in length being nominally 0.1 seconds or multiples thereof in duration, being either on or off, with the second channel being the complement of the first.

Figure 5:
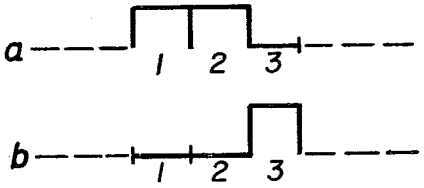
FIG. 5 is an amplitude versus time plot for a typical pulse train necessary to generate one revolution of the prime mover shaft.

Referring now to FIGS. 1-4, the pneumatic signals are conveyed to two parallel passages 26 and 28 transversely positioned in a fixed cover plate 30 and are oriented in an axial direction and interface with the outer face 32 of a composite fusion bound rotating valve plate 34. Rotating valve plate 34 has an internal gear 36 in an inner face and is geared to a piston-cam type prime mover 38 to rotate at ⅛ of the prime mover shaft speed. Therefore, while the prime mover 38 makes 8 revolutions the valve plate 34 makes one revolution. The pneumatic prime mover 38 is of a three cylinder design and must therefore receive a pneumatic pulse transmitted to it for every 120° of drive shaft rotation, or 15° of valve plate rotation. Therefore the valve plate 34 has two series of input ports at 15° intervals corresponding to each power stroke of the motor. The first series of input ports are placed at a radius "*a*" corresponding to the radial position of first cover plate passageway 26 and the second series of input ports at 15° intervals are disposed at a radius "*b*" corresponding to the second cover plate passageway 28. The passages 26 and 28 are oriented diametrically opposite each other at radii "*a*" and "*b*" respectively. A plurality of different pairs of valve plate input ports similar to input ports 40 and 42 in the outer face 32 of the rotating valve plate 34, which are not shown in FIGS. 2, 3 and 4 for clarity, will become aligned with each passage for each 120° of prime mover rotation and each 15° of valve plate rotation. In the position chosen for illustrative purposes, one valve input port such as input port 40 as shown in FIG. 1 will receive a positive pressure pulse while the other input ports 42 and 43 will receive zero pressure. The positive pneumatic pulse will be conveyed through pneumatic line 37 to exit port 45 and thence to a piston such as 44 located in cylinder 55 in the prime mover 38 thus causing rotation of the drive shft 46. After rotation of 120° of the prime mover 38 and the simultaneous rotation of 15° of the valve plate 34, through first drive shaft pinion gear 48 and valve plate idler gear 50, a new pair of ports, not shown but similar to illustrated ports 40 and 42, will become aligned with the first and second passages 26 and 28 respectively. At this instance of time the next pulse bit is present and may appear at either passageway 26 or 28 depending upon the format of the code. Typical dual pulse formats *a* and *b* are shown in FIG. 5. The rotating valve plate 34 acts as a decoder and will convey sequential pressure pulses to the next piston in the prime mover 38 to continue the normal rotation of the drive. Should the pulse appear at the wrong passage, the valve plate 34 will apply the gas pressure from pneumatic supply input 52 to a piston through pneumatic cylinder line 35 in the prime mover 38 to cause rotation in the opposite direction. Furthermore, should the actuator device tend to race ahead of the coded input, a reversing tendency will occur which will synchronize the drive with the input. The crossovers and interconnecting pneumatic lines 37, 39 and 41 which pneumatically connect valve plate input ports 40, 42 and 43 to valve plate exit ports 45, 47 and 49 respectively are necessary to complete the plumbing and are produced by the multi-layered laminated disc members 51 which have grooves photochemically etched therein and diffusion bonded together to form the routing crossovers which are required to form valve plate 34. Since the valve plate 34 and the driveshaft 46 rotate in opposite directions and the porting sequence into the crankcase occurs every 120°, the porting sequence in the valve plate outer face must be at 135°. Therefore "subway" passages are designed in plate valve 34 so that the irregular input pulses at passageways 26 and 28 are unscrambled and delivered to the proper cylinder lines 35 in regular sequence as needed for positive driving action.

The prime mover in this specific embodiment is a three cylinder pneumatic motor of the piston type. The pistons 44 drive a circularly shaped cam 54 which is integrally connected to drive shaft 46 and is straddle supported by a pair of ball bearing members 57. As previously stated, on the outer face surface 32 of the valve plate 34 are two series of ports, each series being located at a different radius. The decoder valve plate is designed so that only one of each series of ports will match each of the passageways 26 and 28 for each 15° of angular rotation of the valve plate 34.

When the coded optical input signal is proper the output of the prime mover 38 will rotate drive shaft 46 so as to biasedly wind torsion spring 56 and drive a gear train 58 and geneva type mechanism 60. Torsion spring 56 has one end 59 fixedly attached to drive shaft 46 and the other end to crankcase 53. Torsion spring 56 acts as a return mechanism in the event that there is a failure to continue the driving signal at either the fiber optic input cable 12, the pneumatic input supply 52, or failure in the electrical circuitry before full activation of the switch actuator assembly 10 has been accomplished. The gear train 58 comprises a second drive shaft pinion gear 62 driving a gear-pinion combination 64 which is offset with respect to the longitudinal axis of the drive shaft 46. The pinion gear 66 drives geneva driver gear 68.

Geneva driver gear 68 is rotatably supported on one end in housing end cover 69 and is designed to make one complete revolution when the prime mover 54 rotates eight turns. Geneva driver gear 68 has a pin 70 transversely positioned in its outer face near the outer circumference of the gear and an axially positioned cam boss 72 having a cam groove 74 therein which is typical of the driver gear of a geneva mechanism. The pin 70 is required after leaving follower slot 76 to make a full 270° rotation before it enters the follower slot 76' of the geneva follower member 78. The follower shaft 80, which is fixedly connected to the follower member 78 and also rotatably supported in housing end cover 69, provides the output motion for the device. An external output gear 82 is mounted on follower shaft 80 and serves to drive a hard switch in the warhead both of which are not shown.

Thus activation of the hard switch is not started until the Geneva driver gear 68 has rotated 270° and the prime mover drive shaft 46 has made six complete turns. This intermediate arming position is reached after the 18th bit of input code has been received having the correct signature. In the event that any bit of input be in error, up to and including the 18th bit, the torsion spring 56 will cause the prime mover shaft to reverse its direction of rotation, the prime mover 38 will lose synchronism and will not reach the point of actuation of the hard switch. Actuation of the missile arming switch is completed as the 19th through 24th bits are received by the fiber optic cable 12. As a final step in the arming sequence, a latch, not shown, engages the geneva follower member 78 to hold the switch closed after all optical, electrical input signals have disappeared.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. A switch actuator for safing and arming a missile: a housing;

optical transducer means fixedly disposed in one end of said housing for converting a coded optical input pulse signal into a coded electrical signal of the same signature as said optical signal;

amplifier means electrically coupled to said optical transducer means for generating an amplified coded electrical output signal in response to said coded electrical signal;

solenoid means having a magnetically operated flapper valve member pivotally connected therewith, said solenoid means being electrically coupled to said amplifier means for converting said amplified coded electrical signal into a reciprocating mechanical motion of said flapper valve member;

pneumatic supply cover means proximately positioned adjacent to said solenoid means, said pneumatic supply cover means having two pneumatic passageways transversely diametrically disposed therethrough, for alternatively generating, in cooperation with said solenoid means, a coded pneumatic output pulse from each of said pneumatic passageways;

rotating valve plate means operatively disposed adjacent said pneumatic supply cover means, for mechanically decoding each of said coded pneumatic output pulses into sequential pressure pulses;

pneumatic piston-cam type prime mover means having a pneumatic input pneumatically connected to the output of said rotating valve plate means, said prime mover means being gear-connected to said rotating valve plate means to rotate said valve plate means at $\frac{1}{8}$ of the prime mover means speed;

geneva movement means having a driver gear assembly and a follower assembly, said geneva movement means being gear connected to said prime mover means, said geneva driver gear assembly rotating at $\frac{1}{8}$ the prime mover means speed, said geneva movement means requiring full 270° rotation of said driver gear assembly prior to said switch actuator being placed in an intermediate arming position, and requiring two additional complete turns before said driver gear assembly causes said follower assembly to make a complete revolution which will then place said missile in an armed condition; and biasing means operatively disposed on said prime mover means intermediate said geneva movement means and said primer mover means for returning said switch actuator to a fail-safe position when said optical transducer means fails to receive a coded optical signal of a specific signature for a given duration.

2. A switch actuator as recited in claim 1 wherein said optical transducer means comprises:

a fiber optic cable fixedly attached to said housing for transmitting said coded optical input signal;

a photosensitive cell having an input optically in-line with said fiber optic cable for converting said coded optical input signal into said coded electrical signal.

3. A switch actuator as recited in claim 1 wherein said rotating valve plate means comprises multi-layered disc members fusion bonded together having photochemically etched grooves therein, said disc members being bonded to form a valve plate having an outer face with a plurality of input ports therein which are interconnected by said photochemically etched grooves to a plurality of valve plate exit ports on the other side of said valve plate, said valve plate input ports being operatively disposed to receive a 15° porting sequence, said plurality of exit ports being disposed to receive a 135° porting interval, said photo-etched grooves acting as interconnecting passageways to decode irregular coded input pulses received from said pneumatic supply cover means into regular sequenced pressure pulses to drive said pneumatic piston-cam type prime mover means.

4. A switch actuator as recited in claim 1 wherein said pneumatic pistoncam type prime mover means comprises:

a crankcase having three piston cylinders spaced 120° apart, said three piston cylinders being pneumatically connected to said plurality of valve plate exit ports by pneumatic cylinder lines;

three pistons being slidably disposed in said piston cylinders;

a prime mover circularly shaped cam having a drive shaft operatively connected thereto, said cam being in slidable contact with one end of each of said three pistons, said drive shaft having a first drive shaft pinion gear on one end thereof and a second drive shaft pinion gear on the other end thereof said second drive shaft pinion gear mechanically coupled to said geneva movement means for actuating said switch actuator after 8 complete revolutions of said prime mover means; and an idler gear rotatably supported in said crankcase mechanically connecting said rotating valve plate means to said first drive shaft pinion so that said drive shaft of said prime mover means makes 8 revolutions to each revolution of said rotating valve plate means; and a pair of ball bearing members fixedly positioned in said crankcase to straddle support said cam and drive shaft.

5. A switch actuator as recited in claim 4 wherein said biasing means comprises a helically shaped torsion spring biasedly disposed intermediate said second drive shaft pinion gear and said crankcase, said torsion spring having one end fixedly positioned in said drive shaft and another end fixedly disposed in said crankcase.

* * * * *